US007686134B1

(12) United States Patent
Harris

(10) Patent No.: US 7,686,134 B1
(45) Date of Patent: Mar. 30, 2010

(54) LADDER SUPPORT AND BRACING APPARATUS

(76) Inventor: Jimmy L. Harris, 4541 Sylvester Cir., Macon, GA (US) 31217

( * ) Notice: Subject to any disclaimer, the term of this patent is extended or adjusted under 35 U.S.C. 154(b) by 715 days.

(21) Appl. No.: 11/371,954

(22) Filed: Mar. 10, 2006

(51) Int. Cl.
*E06C 7/00* (2006.01)

(52) U.S. Cl. ..... 182/200; 182/222

(58) Field of Classification Search ..... 182/200, 182/222, 223; 248/439
See application file for complete search history.

(56) References Cited

U.S. PATENT DOCUMENTS 1,057,722 A * 4/1913 Goetz ..... 248/439
1,325,423 A * 12/1919 Stuart ..... 4/578.1
2,549,638 A * 4/1951 Rogghe ..... 248/237
4,133,272 A * 1/1979 Naglowsky ..... 108/132
D268,133 S 3/1983 Drake
4,457,397 A 7/1984 Scala
5,339,921 A 8/1994 Faupel
5,697,180 A * 12/1997 Morizio ..... 42/94
5,715,910 A 2/1998 Koch et al.
5,746,288 A * 5/1998 O'Neal et al. ..... 182/118
5,967,261 A 10/1999 Sandham et al.
6,044,929 A 4/2000 Wishner
6,557,666 B1 * 5/2003 Drouin ..... 182/129

FOREIGN PATENT DOCUMENTS

GB 2208172 A * 3/1989

* cited by examiner

*Primary Examiner*—Alvin C Chin-Shue

(57) ABSTRACT

A ladder support and bracing apparatus includes a panel that has a top side, a bottom side, a first end, a second end, a first lateral side and a second lateral side. Each of a pair of lips is attached to and extends upwardly from the top side and each is coextensive with one of the first and second lateral sides. A vertical support is hingedly coupled to the bottom side and is positioned adjacent to the first end. The panel is substantially horizontally orientated when the vertical support is vertically orientated. The bottom side of the panel adjacent to the second is positioned on a step and the vertical support adjusted to horizontally orientate the panel. A ladder is then positioned on and supported by the panel.

10 Claims, 3 Drawing Sheets

LADDER SUPPORT AND BRACING APPARATUS

BACKGROUND OF THE INVENTION

1. Field of the Invention

The present invention relates to support devices and more particularly pertains to a new support device for supporting both legs of a ladder when the ladder is being used on stairs.

2. Description of the Prior Art

The use of support devices, and those for supporting ladders, is known in the prior art. While these devices fulfill their respective, particular objectives and requirements, the need remains for a device that includes particular adjustment means for allowing a ladder to be positioned on stairs having different inclines. Further, the device should include means to prevent movement of the device relative to the stairs and to ensure that the ladder does not slide off of the device.

SUMMARY OF THE INVENTION

The present invention meets the needs presented above by generally comprising a panel that has a top side, a bottom side, a first end, a second end, a first lateral side and a second lateral side. Each of a pair of lips is attached to and extends upwardly from the top side and each is coextensive with one of the first and second lateral sides. A vertical support is hingedly coupled to the bottom side and is positioned adjacent to the first end. The panel is substantially horizontally orientated when the vertical support is vertically orientated. The bottom side of the panel adjacent to the second is positioned on a step and the vertical support adjusted to horizontally orientate the panel. A ladder is then positioned on and supported by the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
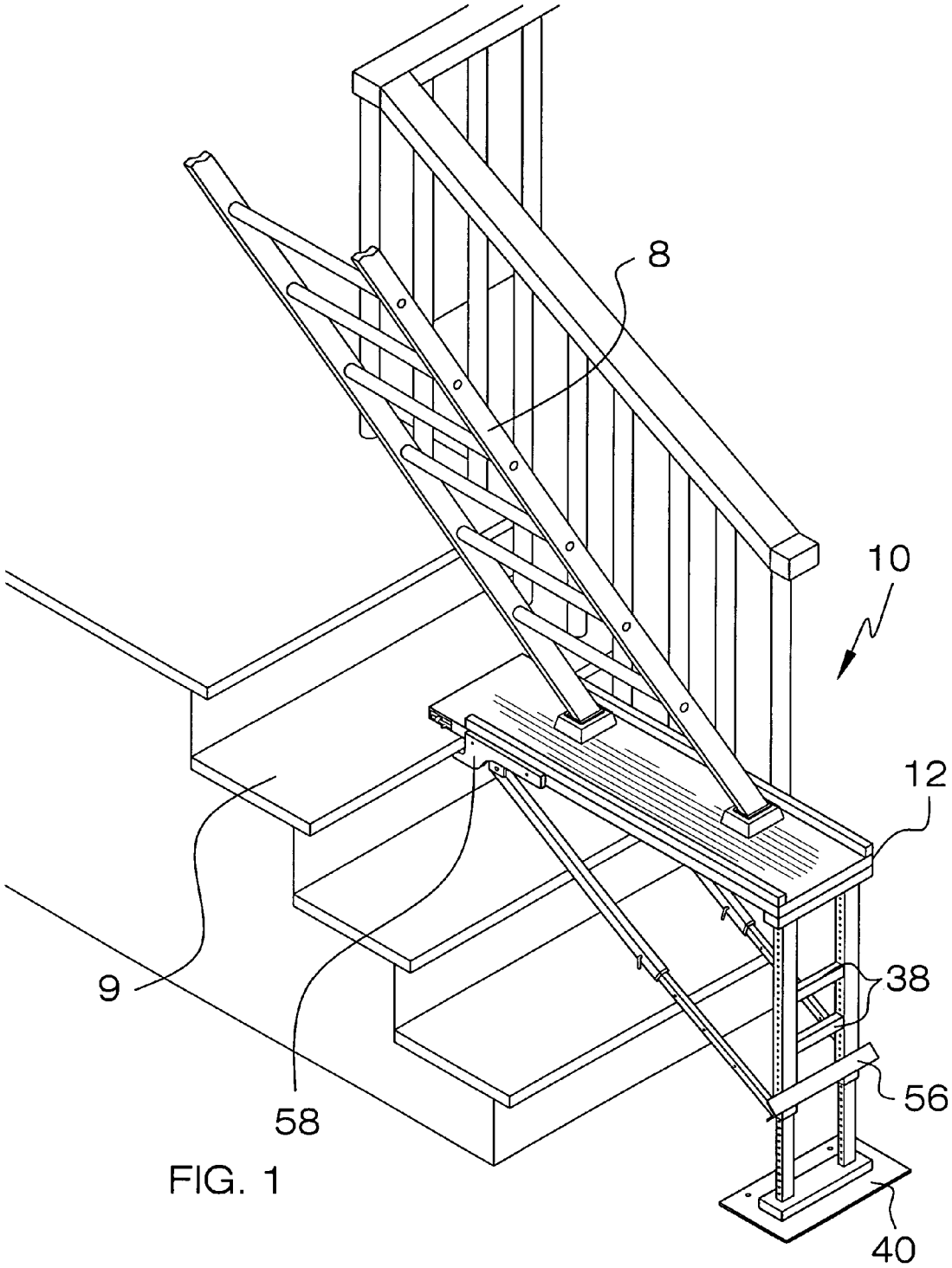
FIG. 1 is a perspective in-use view of a ladder support and bracing apparatus according to the present invention.
Figure 2:
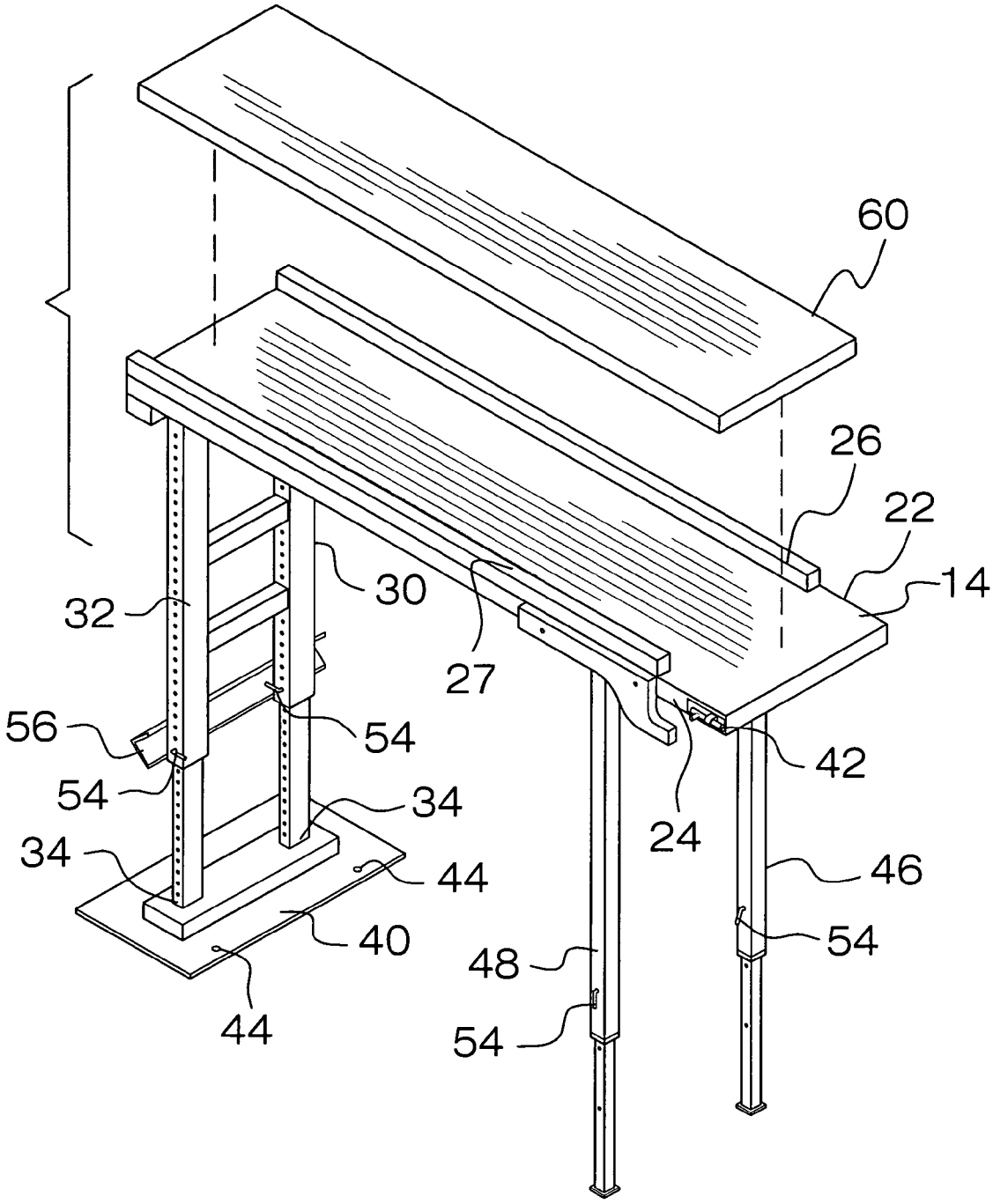
FIG. 2 is a perspective view of the present invention.
Figure 3:
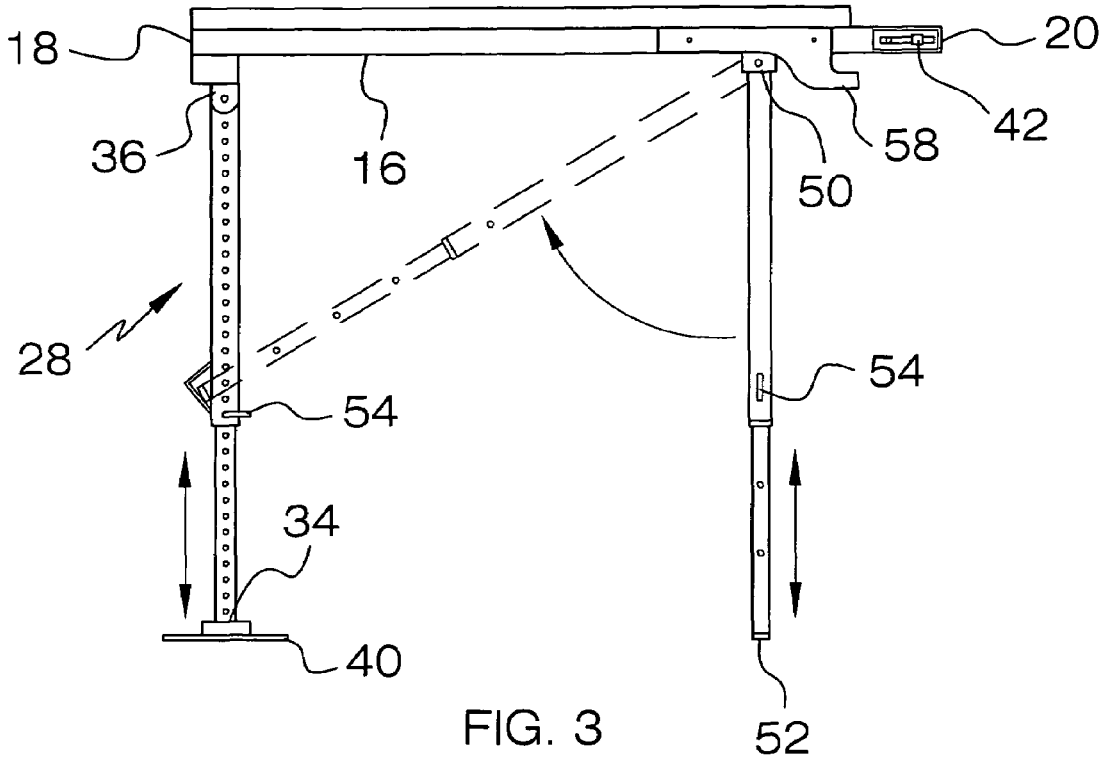
FIG. 3 is a side view of the present invention.
Figure 4:
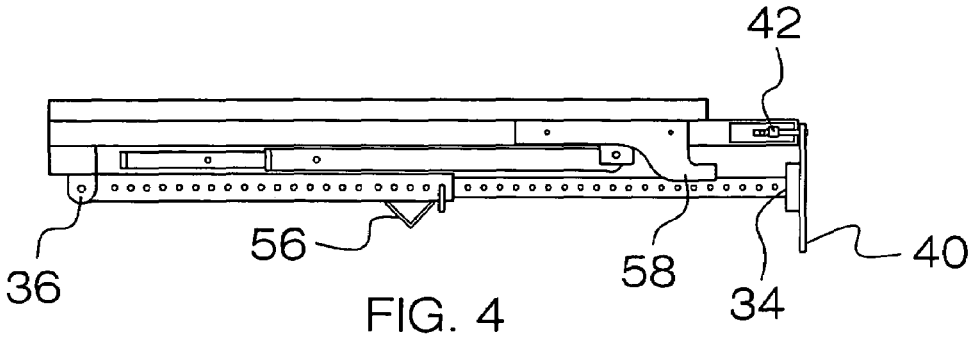
FIG. 4 is a side view of the present invention.

With reference now to the drawings, and in particular to FIGS. 1 through 4 thereof, a new support device embodying the principles and concepts of the present invention and generally designated by the reference numeral 10 will be described.

As best illustrated in FIGS. 1 through 4, the ladder support and bracing apparatus 10 is configured to support a ladder 8 on stairs 9. The apparatus 10 includes a panel 12 has a top side 14, a bottom side 16, a first end 18, a second end 20, a first lateral side 22 and a second lateral side 24. Each one of a pair of lips 26, 27 is attached to and extends upwardly from the top side 14 and each is coextensive with one of the first 22 and second 24 lateral sides. The panel has length from the first end 18 to the second end 20 between 30 inches and 60 inches.

A vertical support 28 is hingedly coupled to the bottom side 16 and is positioned adjacent to the first end 18. The panel 12 is substantially horizontally orientated when the vertical support 28 is vertically orientated. The vertical support 28 is telescoping and has a selectively adjustable height. The vertical support 28 includes a first leg 30 and a second leg 32. Each of the first 30 and second 32 legs has a bottom end 34 and a top end 36. The bottom ends 34 are hingedly coupled to the bottom side 16 and each is positioned adjacent to one of the first 22 and second 24 lateral edges. A plurality of rods 38 is attached to and extends between the first 30 and second 32 legs. The rods 38 each define a foot step for climbing the vertical support 28.

A planar base 40 is attached to the bottom ends 34 of the first 30 and second 32 legs. The base 40 lies in a plane orientated perpendicular to a longitudinal axis of the first leg 30. A locking member 42 is positioned on the panel 12 and is configured to releasably lock the base 40 to the second end 20 of the panel 12 so that the first 30 and second 32 legs extend along the bottom side 16 of the panel 12 in a stored position. The locking member 42 includes at least one pin slidably coupled to the panel and is extendable through an aperture 44 in the base 40 when a plane of the base 40 is orientated substantially perpendicular to a plane of the panel 12.

A third leg 46 and a fourth leg 48 are provided. Each of the third 46 and fourth 48 legs has an upper end 50 and a lower end 52. Each of the upper ends 50 is hingedly coupled to the bottom side 16 of the panel 12. The third 44 and fourth 48 legs are spaced between 4 inches and 12 inches from the second end 20 of the panel 12. Each of the third 46 and fourth 48 legs is telescopic and has a selectively adjustable height. Pins 54 extended through the first 30, second 32, third 46 and fourth 48 legs are used to lock each at a selected height. A brace 56 is attached to the vertical support 28. Each of the lower ends 52 of the third 46 and fourth 48 legs is positionable on the brace 56. The third 46 and fourth 48 legs form an angle less than 50 degrees with the panel 12 when the lower ends 52 are positioned on the brace 56. In this manner, the third 46 and fourth 48 legs may be used as stabilizers for the apparatus 10, though they may also be used as conventional legs to increase and overall height of the apparatus 10.

A pair of catches 58 is attached to the panel 12. Each of the catches 58 is attached to one of the first 22 and second 24 lateral sides. Each of the catches 58 is positioned below a plane of the bottom side 16 and extends toward the second end 20. The catches 58 are positioned between the second end 20 and the upper ends 50 of the third 46 and fourth 48 legs.

A plate 60 is removably positionable on the top side 14 of the panel 12. The plate 60 extends from a first of the lips 26 to a second of the lips 27 and extends from the first end 18 to the second end 20. The plate 60 is positioned on the panel 12 to define a platform when a person wishes to stand on the panel 12 itself and not use a ladder 8. The plate 60 preferably has a height equal to the height of the lips 26, 27 and will prevent a person from tripping on the lips 26, 27.

In use, the bottom side 16 of the panel 12 adjacent to the second is positioned on a step 9 and the vertical support 28 adjusted to horizontally orientate the panel 12. The catches 58 are abutted against a step 9 to laterally stabilize the apparatus 10. A ladder 8 is positioned on the top side 14 and may be abutted against one of the lips 26, 27 to prevent the sliding of the ladder 8 off of the panel 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder support assembly configured to support a ladder on stairs, said assembly including:

a panel having a top side, a bottom side, a first end, a second end, a first lateral side and a second lateral side;

a pair of lips, each of said lips being attached to and extending upwardly from said top side and each being coextensive with one of said first and second lateral sides;

a vertical support being hingedly coupled to said bottom side and being positioned adjacent to said first end, said panel being substantially horizontally orientated when said vertical support is vertically orientated, said vertical support including a first leg and a second leg, each of said first and second legs having a bottom end and a top end, each of said top ends being hingedly coupled to said bottom side and each being positioned adjacent to one of said first and second lateral side, a planar base being attached to said bottom ends of said first and second legs, said base lying in a plane orientated perpendicular to a longitudinal axis of said first leg, said base having an aperture extending through the base perpendicular to the plane of the base, a locking member being positioned on said panel and being configured to releasably lock said base to said second end of said panel wherein said first and second legs are extending along said bottom side of said panel, said locking member includes at least one pin positioned on one of said first and second lateral side and slidable along a longitudinal axis of said one of said first and second lateral side and being extendable through said aperture in said base when a plane of said base is orientated substantially perpendicular to a plane of said panel, said pin being orientated perpendicular to a plane of said base when said pin is extended through said base; and wherein said bottom side of said panel adjacent to said second end may be positioned on a step and said vertical support adjusted to horizontally orientate said panel.

2. The assembly according to claim 1, wherein said vertical support is telescoping and has a selectively adjustable height.

3. The assembly according to claim 1, further including a plurality of rods being attached to and extending between said first and second legs, each of said rods defining a foot step for climbing said vertical support.

4. The assembly according to claim 1, further including a third leg and a fourth leg, each of said third and fourth legs having an upper end and a lower end, each of said upper ends being hingedly coupled to said bottom side of said panel, said third and fourth legs being spaced between 4 inches and 12 inches from said second end of said panel.

5. The assembly according to claim 4, wherein each of said third and fourth legs is telescopic and has a selectively adjustable height.

6. The assembly according to claim 4, further including a brace being attached to said vertical support, each of said lower ends of said third and fourth legs being positionable on said brace.

7. The assembly according to claim 1, further including a pair of catches, each of said catches being attached to one of said first and second lateral sides, each of said catches being positioned below a plane of said bottom side and extending toward said second end, said catches being positioned nearer to said second end than said first end.

8. The assembly according to claim 4, further including a pair of catches, each of said catches being attached to one of said first and second lateral sides, each of said catches being positioned below a plane of said bottom side and extending toward said second end, each of said catches being positioned between said second end and said upper ends of said third and fourth legs.

9. The assembly according to claim 1, further including a plate being removably positionable on said top side of said panel, said plate extending from a first of said lips to a second of said lips and extending from said first end to said second end.

10. A ladder support assembly configured to support a ladder on stairs, said assembly including:

a panel having a top side, a bottom side, a first end, a second end, a first lateral side and a second lateral side;

a pair of lips, each of said lips being attached and extending upwardly from said top side and each being coextensive with one of said first and second lateral sides;

a vertical support being hingedly coupled to said bottom side and being positioned adjacent to said first end, said panel being substantially horizontally orientated when said vertical support is vertically orientated, said vertical support being telescoping and having a selectively adjustable height, said vertical support including a first leg and a second leg, each of said first and second legs having a bottom end and a top end, each of said top ends being hingedly coupled to said bottom side and each being positioned adjacent to one of said first and second lateral side, a plurality of rods being attached to and extending between said first and second legs, each of said rods defining a foot step for climbing said vertical support;

a planar base being attached to said bottom ends of said first and second legs, said base lying in a plane orientated perpendicular to a longitudinal axis of said first leg, said base having an aperture extending through the base perpendicular to the plane of the base;

a locking member being positioned on said panel and being configured to releasably lock said base to said second end of said panel wherein said first and second legs are extending along said bottom side of said panel, said locking member including at least one pin positioned on one of said first and second lateral side and slidable along a longitudinal axis of said one of said first and second lateral side and being extendable through said aperture in said base when a plane of said base is orientated substantially perpendicular to a plane of said panel, said pin being orientated perpendicular to a plane of said base when said pin is extended through said base;

a third leg and a fourth leg, each of said third and fourth legs having an upper end and a lower end, each of said upper ends being hingedly coupled to said bottom side of said panel, said third and fourth legs being spaced between 4 inches and 12 inches from said second end of said panel, each of said third and fourth legs being telescopic and having a selectively adjustable height;

a brace being attached to said vertical support, each of said lower ends of said third and fourth legs being positionable on said brace, said third and fourth legs forming an angle less than 50 degrees with said panel when said lower ends are positioned on said brace;

a pair of catches, each of said catches being attached to one of said first and second lateral sides, each of said catches being positioned below a plane of said bottom side and extending toward said second end, each of said catches being positioned between said second end and said upper ends of said third and fourth legs;

a plate being removably positionable on said top side of said panel, said plate extending from a first of said lips to a second of said lips and extending from said first end to said second end; and wherein said bottom side of said panel adjacent to said second end may be positioned on a step and said vertical support adjusted to horizontally orientate said panel.

* * * * *